US012127679B2

(12) United States Patent
DeMoss et al.

(10) Patent No.: US 12,127,679 B2
(45) Date of Patent: Oct. 29, 2024

(54) POCKET COIL SPRING ASSEMBLY INCLUDING FLEXIBLE FOAM

(71) Applicant: Sealy Technology, LLC, Trinity, NC (US)

(72) Inventors: Larry K. DeMoss, Greensboro, NC (US); Darin T. Thomas, Salisbury, NC (US); Brian M. Manuszak, Thomasville, NC (US); Stephen Wallace, Duffield, VA (US)

(73) Assignee: Sealy Technology, LLC, Trinity, NC (US)

( * ) Notice: Subject to any disclaimer, the term of this patent is extended or adjusted under 35 U.S.C. 154(b) by 503 days.

(21) Appl. No.: 16/758,150

(22) PCT Filed: Oct. 29, 2018

(86) PCT No.: PCT/US2018/057948
§ 371 (c)(1),
(2) Date: Apr. 22, 2020

(87) PCT Pub. No.: WO2019/089429
PCT Pub. Date: May 9, 2019

(65) Prior Publication Data

US 2020/0281367 A1 Sep. 10, 2020

Related U.S. Application Data

(60) Provisional application No. 62/579,209, filed on Oct. 31, 2017.

(51) Int. Cl.
*A47C 27/05* (2006.01)
*A47C 27/06* (2006.01)
(Continued)

(52) U.S. Cl.
CPC ..... *A47C 27/05* (2013.01); *A47C 27/064* (2013.01); *A47C 27/063* (2013.01); *A47C 27/14* (2013.01); *A47C 27/20* (2013.01)

(58) Field of Classification Search
CPC ..... A47C 27/05; A47C 27/064; A47C 27/14; A47C 27/063; A47C 27/20
See application file for complete search history.

(56) References Cited

U.S. PATENT DOCUMENTS 26,954 A 1/1860 Peck, Jr.
44,793 A 10/1864 Fuller
(Continued)

FOREIGN PATENT DOCUMENTS

AT 309725 T 12/2005
AU 2457571 A 7/1972
(Continued)

OTHER PUBLICATIONS

Korean Intellectual Property Office, International Search Report and Written Opinion for PCT/US2018/057948 dated Jan. 30, 2019, 10 pages.
(Continued)

*Primary Examiner* — Justin C Mikowski
*Assistant Examiner* — Morgan J McClure
(74) *Attorney, Agent, or Firm* — Stites & Harbison, PLLC; Terry L. Wright; James R. Hayne

(57) ABSTRACT

A pocket coil spring assembly is provided that includes a coil spring having an upper portion and a lower portion collectively defining an interior cavity of the coil spring. The pocket coil spring assembly further includes a fabric pocket encasing the coil spring with a top area covering the upper portion of the coil spring and a bottom area covering the lower portion of the coil spring. A discrete amount of flexible foam is poured on the top of the fabric pocket such
(Continued)

that a top surface of the flexible foam extends above the coil spring. A mattress assembly is further provided that includes the flexible foam dispensed in continuous or discrete amounts between rows of pocket coil springs.

6 Claims, 4 Drawing Sheets

(51) Int. Cl.
*A47C 27/14* (2006.01)
*A47C 27/20* (2006.01)

(56) References Cited

U.S. PATENT DOCUMENTS 85,938 A 1/1869 Kirkpatrick
140,975 A 7/1873 Wert et al.
184,703 A 11/1876 Camp
274,715 A 3/1883 Buckley
380,651 A 4/1888 Fowler et al.
399,867 A 3/1889 Gall et al.
409,024 A 5/1889 Wagner et al.
485,652 A 11/1892 Pfingst
569,256 A 10/1896 Van Cise
804,352 A 11/1905 Van Cise
859,409 A 7/1907 Radarmacher
1,025,489 A 5/1912 Thompson
1,211,267 A 1/1917 Young
1,250,892 A 12/1917 Johnson
1,253,414 A 1/1918 D'Arcy
1,284,384 A 11/1918 Lewis
1,337,320 A 4/1920 Karr
1,344,636 A 6/1920 Jackson
1,744,389 A 1/1930 Karr
1,745,892 A 2/1930 Edwards
1,745,986 A 2/1930 Edwards
1,751,261 A 3/1930 Wilson
1,798,885 A 3/1931 Karr
1,804,821 A 5/1931 Stackhouse
1,839,325 A 1/1932 Marquardt
1,879,172 A 9/1932 Gail
1,907,324 A 5/1933 Kirchner
1,938,489 A 12/1933 Karr
1,950,770 A 3/1934 Bayer
1,989,302 A 1/1935 Wilmot
2,054,868 A 9/1936 Schwartzman
D109,730 S 5/1938 Powers
2,148,961 A 2/1939 Pleet
2,214,135 A 9/1940 Hickman
2,348,897 A 5/1944 Gladstone
2,403,043 A 7/1946 Bowersox
2,480,158 A 8/1949 Owen
2,562,099 A 7/1951 Hilton
2,614,681 A 10/1951 Keil
2,577,812 A 12/1951 Samel
2,611,910 A 9/1952 Bell
2,617,124 A 11/1952 Johnson
2,681,457 A 6/1954 Rymland
2,866,433 A 12/1958 Kallick et al.
2,889,562 A 6/1959 Gleason
2,972,154 A 2/1961 Raszinski
3,083,381 A 4/1963 Bailey
3,089,154 A 5/1963 Boyles
3,107,367 A 10/1963 Nachman
3,173,159 A 3/1965 Hart
3,256,535 A 6/1966 Anson
3,430,275 A 3/1969 Janapol
3,517,398 A 6/1970 Patton
3,533,114 A 10/1970 Karpen
3,538,521 A 11/1970 Basner
3,541,827 A 11/1970 Hansen
3,653,081 A 4/1972 Davis
3,653,082 A 4/1972 Davis
3,690,456 A 9/1972 Powers, Jr.
3,633,228 A 11/1972 Zysman
3,708,809 A 1/1973 Basner
3,735,431 A 5/1973 Zocco
3,751,025 A 8/1973 Beery et al.
D230,683 S 3/1974 Roe
3,869,739 A * 3/1975 Klein ..... A47C 27/20 5/718
3,016,464 A 11/1975 Tyhanci
3,923,293 A 12/1975 Wiegand
3,938,653 A 2/1976 Senger
4,077,619 A 3/1978 Borlinghaus
4,092,749 A 6/1978 Klancnik
4,109,330 A 8/1978 Klancnik
4,111,407 A 9/1978 Stager
4,122,566 A 10/1978 Yates
4,155,130 A 5/1979 Roe
4,160,544 A 7/1979 Higgins
4,164,281 A 8/1979 Schnier
4,257,151 A 3/1981 Coots
4,388,738 A 6/1983 Wagner
4,439,977 A 4/1984 Stumpf
4,485,506 A 12/1984 Stumpf et al.
4,519,107 A 5/1985 Dillon et al.
4,523,344 A 6/1985 Stumpf
4,533,033 A 8/1985 van Wegen
4,535,978 A 8/1985 Wagner
4,548,390 A 10/1985 Sasaki
4,566,926 A 1/1986 Stumpf et al.
4,578,834 A 4/1986 Stumpf et al.
4,609,186 A 9/1986 Thoenen et al.
4,664,361 A 5/1987 Sasaki
4,726,572 A 2/1988 Flesher et al.
D28,896 S 6/1988 Comstock
4,817,924 A 4/1989 Thoenen et al.
4,901,387 A * 2/1990 Luke ..... A47C 27/146 5/736
4,960,267 A 10/1990 Scott et al.
5,040,255 A 8/1991 Barber
5,127,509 A 7/1992 Kohlen
5,127,635 A 7/1992 Long et al.
5,153,956 A * 10/1992 Nold ..... A61G 7/05707 428/218
5,222,264 A * 6/1993 Morry ..... A47C 27/063 267/95
5,303,436 A * 4/1994 Dinsmoor, III ..... A47C 27/148 5/719
5,319,815 A 6/1994 Stumpf et al.
5,363,522 A 11/1994 McGraw
5,416,936 A * 5/1995 Chan ..... A47C 31/003 601/134
5,426,799 A * 6/1995 Ottiger ..... A47C 23/06 5/247
5,444,905 A 8/1995 St. Clair
5,575,460 A 11/1996 Knoepfel et al.
5,584,083 A 12/1996 Ramsey et al.
5,701,623 A 12/1997 May
5,713,088 A 2/1998 Wagner et al.
5,720,471 A 2/1998 Constantinescu
5,724,686 A 3/1998 Neal
5,787,532 A 8/1998 Langer et al.
5,803,440 A 9/1998 Wells
5,832,551 A 11/1998 Wagner
5,836,027 A * 11/1998 Leventhal ..... A47C 27/20 5/713
5,868,383 A 2/1999 Codos
D409,024 S 5/1999 Wagner et al.
6,134,729 A 10/2000 Quintile et al.
6,149,143 A 11/2000 Richmond et al.
6,155,310 A 12/2000 Haubert et al.
6,199,234 B1 * 3/2001 Srour ..... A47C 27/146 5/736
6,243,900 B1 6/2001 Gladney et al.
6,256,820 B1 7/2001 Moser et al.
6,260,223 B1 7/2001 Mossbeck et al.
6,263,533 B1 7/2001 Dimitry et al.
6,272,706 B1 8/2001 McCune
6,315,275 B1 11/2001 Zysman
6,318,416 B1 11/2001 Grueninger
6,336,305 B1 1/2002 Graf et al.

(56) References Cited

U.S. PATENT DOCUMENTS 6,339,857 B1 1/2002 Clayton
6,354,577 B1 3/2002 Quintile et al.
6,375,169 B1 4/2002 McCraw et al.
6,398,199 B1 6/2002 Barber
6,406,009 B1 6/2002 Constantinescu et al.
6,408,469 B2 6/2002 Gladney et al.
6,430,982 B2 8/2002 Andrea et al.
6,467,240 B2 10/2002 Zysman
6,481,701 B2 11/2002 Kessen et al.
6,490,744 B1 * 12/2002 Schulz, Jr. ..... A47C 27/063 5/716
6,540,214 B2 4/2003 Barber
6,591,438 B1 * 7/2003 Edling ..... A47C 27/064 5/655.8
6,640,836 B1 11/2003 Haubert et al.
6,659,261 B2 12/2003 Miyakawa
6,698,166 B2 3/2004 Zysman
6,729,610 B2 5/2004 Constantinescu
6,758,078 B2 6/2004 Wells et al.
6,772,463 B2 8/2004 Gladney et al.
6,883,196 B2 4/2005 Barber
6,931,685 B2 8/2005 Kuchel et al.
6,952,850 B2 10/2005 Visser et al.
6,966,091 B2 11/2005 Barber
7,044,454 B2 5/2006 Colman et al.
7,048,263 B2 5/2006 Ahlqvist
7,063,309 B2 6/2006 Colman
7,086,425 B2 8/2006 Widmer
D527,932 S 9/2006 Eigenmann et al.
D528,329 S 9/2006 Eigenmann et al.
D528,330 S 9/2006 Eigenmann et al.
D528,833 S 9/2006 Eigenmann et al.
D530,120 S 10/2006 Eigenmann et al.
D531,436 S 11/2006 Eigenmann et al.
7,168,117 B2 1/2007 Gladney et al.
7,178,187 B2 2/2007 Barman et al.
7,185,379 B2 3/2007 Barman
7,219,381 B2 5/2007 Damewood et al.
7,287,291 B2 10/2007 Carlitz
7,386,897 B2 6/2008 Eigenmann et al.
7,404,223 B2 7/2008 Manuszak et al.
D579,242 S 10/2008 Kilic
7,578,016 B1 8/2009 McCraw
7,636,971 B2 12/2009 Demoss
7,748,065 B2 7/2010 Edling
D621,186 S 8/2010 Demoss
D621,198 S 8/2010 Morrison
D622,088 S 8/2010 Morrison
7,805,790 B2 10/2010 Demoss
7,814,594 B2 10/2010 DeFranks et al.
D633,322 S 3/2011 Morrison
7,908,693 B2 3/2011 Demoss
7,921,561 B2 4/2011 Eigenmann et al.
D640,082 S 6/2011 Morrison
D649,385 S 11/2011 Freese et al.
D651,828 S 1/2012 DeMoss et al.
D652,234 S 1/2012 Demoss et al.
D652,235 S 1/2012 Demoss et al.
8,157,084 B2 4/2012 Begin et al.
D659,459 S 5/2012 Jung et al.
D662,751 S 7/2012 Morrison et al.
D662,752 S 7/2012 Morrison et al.
8,230,538 B2 7/2012 Moret et al.
D666,448 S 9/2012 Morrison et al.
D666,449 S 9/2012 Morrison et al.
D696,048 S 12/2013 Morrison
8,628,067 B2 * 1/2014 Pearce ..... A47C 27/16 5/655.5
D704,478 S 5/2014 Arnold
D704,965 S 5/2014 Arnold
8,720,872 B2 5/2014 DeMoss et al.
D708,455 S 7/2014 Arnold
8,783,447 B1 7/2014 Yohe
D711,160 S 8/2014 Arnold
8,793,821 B2 * 8/2014 Fowkes ..... A47K 3/002 4/578.1
8,857,799 B2 10/2014 Tyree
D717,077 S 11/2014 Arnold
D717,078 S 11/2014 Arnold
8,895,109 B2 * 11/2014 Blanga Cohen ..... A47C 23/002 267/91
D719,766 S 12/2014 Arnold
D720,159 S 12/2014 Arnold
9,022,369 B2 5/2015 Demoss et al.
9,085,420 B2 7/2015 Williams
D744,767 S 12/2015 Morrison et al.
D744,768 S 12/2015 Morrison et al.
9,211,017 B2 12/2015 Tyree
9,352,913 B2 5/2016 Manuszak et al.
9,392,876 B2 7/2016 Tyree
D763,013 S 8/2016 Arnold
D776,958 S 1/2017 Arnold
D776,959 S 1/2017 Arnold
9,936,815 B2 4/2018 DeMoss et al.
10,051,973 B2 8/2018 Morgan et al.
10,188,219 B2 * 1/2019 Codos ..... A47C 27/056
10,357,116 B2 * 7/2019 Fisher ..... A47C 7/18
10,598,242 B2 3/2020 Thomas et al.
10,610,029 B2 4/2020 Demoss et al.
11,013,340 B2 * 5/2021 Jewett ..... B68G 7/02
11,026,517 B2 * 6/2021 DeMoss ..... A47C 27/064
11,229,299 B1 * 1/2022 Peterson ..... A47C 27/056
2001/0008030 A1 7/2001 Gladney et al.
2001/0013147 A1 8/2001 Fogel
2002/0139645 A1 10/2002 Haubert et al.
2002/0152554 A1 10/2002 Spinks et al.
2003/0093864 A1 5/2003 Visser et al.
2003/0101517 A1 * 6/2003 Choi ..... A47C 27/15 5/655.9
2003/0177585 A1 9/2003 Gladney et al.
2004/0046297 A1 3/2004 Demoss et al.
2004/0074005 A1 4/2004 Kuchel
2004/0079780 A1 4/2004 Kato
2004/0133988 A1 7/2004 Barber
2004/0237204 A1 12/2004 Antinori
2004/0261187 A1 12/2004 Van Patten
2005/0246839 A1 11/2005 Noswonger
2006/0042016 A1 3/2006 Barman et al.
2006/0290039 A1 * 12/2006 Cao ..... F16F 1/376 267/153
2007/0017033 A1 1/2007 Antinori
2007/0017035 A1 1/2007 Chen et al.
2007/0094807 A1 5/2007 Wells
2007/0124865 A1 6/2007 Stjerma
2007/0169275 A1 7/2007 Manuszak et al.
2007/0220680 A1 9/2007 Miller et al.
2007/0220681 A1 9/2007 Gladney et al.
2007/0289068 A1 12/2007 Edling
2008/0017255 A1 1/2008 Petersen
2008/0017271 A1 1/2008 Haltiner
2008/0093784 A1 * 4/2008 Rawls-Meehan .... A47C 27/148 267/80
2008/0115287 A1 5/2008 Eigenmann et al.
2009/0183314 A1 * 7/2009 Demoss ..... A47C 27/062 267/153
2009/0193591 A1 8/2009 DeMoss et al.
2010/0180385 A1 7/2010 Petrolati et al.
2010/0212090 A1 8/2010 Stjerma
2010/0257675 A1 10/2010 Demoss
2011/0061163 A1 * 3/2011 Lee ..... A47C 27/056 5/717
2011/0094039 A1 4/2011 Tervo et al.
2011/0099722 A1 5/2011 Moret et al.
2011/0107523 A1 5/2011 Moret et al.
2011/0148018 A1 6/2011 DeFranks et al.
2012/0047658 A1 3/2012 Demoss et al.
2012/0159715 A1 6/2012 Jung et al.
2012/0180224 A1 7/2012 Demoss et al.
2013/0031726 A1 2/2013 Demoss
2013/0081207 A1 * 4/2013 Cohen ..... A47C 27/062 267/143
2014/0033441 A1 2/2014 Morgan et al.

(56) References Cited

U.S. PATENT DOCUMENTS

| | | | | |
|---|---|---|---|---|
| 2014/0208517 | A1 | 7/2014 | Gross et al. | |
| 2014/0373280 | A1 | 12/2014 | Mossbeck et al. | |
| 2015/0342362 | A1* | 12/2015 | DeMoss | A47C 27/20 5/718 |
| 2015/0374136 | A1 | 12/2015 | Mikkelsen et al. | |
| 2016/0029809 | A1 | 2/2016 | Shive | |
| 2016/0029811 | A1* | 2/2016 | Rawls-Meehan | G06Q 10/101 5/729 |
| 2016/0037938 | A1 | 2/2016 | Tyree | |
| 2016/0045034 | A1* | 2/2016 | Häger | A47C 27/064 267/145 |
| 2016/0166076 | A1* | 6/2016 | Mossbeck | A47C 27/066 297/452.5 |
| 2016/0255964 | A1 | 9/2016 | Thomas | |
| 2016/0270545 | A1* | 9/2016 | Codos | A47C 27/07 |
| 2016/0316927 | A1* | 11/2016 | Thomas | A47C 27/064 |
| 2016/0367042 | A1* | 12/2016 | Fisher | A47C 27/20 |
| 2017/0258242 | A1* | 9/2017 | Codos | A47C 27/056 |
| 2018/0055240 | A1 | 3/2018 | Demoss et al. | |
| 2018/0168360 | A1 | 6/2018 | Thomas et al. | |
| 2018/0368585 | A1 | 12/2018 | Demoss et al. | |
| 2019/0000239 | A1 | 1/2019 | Thomas et al. | |
| 2019/0216241 | A1* | 7/2019 | Codos | A47C 27/04 |
| 2019/0343294 | A1 | 11/2019 | Demoss et al. | |
| 2019/0380503 | A1* | 12/2019 | Stjerna | A47C 7/20 |
| 2020/0018370 | A1 | 1/2020 | Demoss et al. | |
| 2020/0281367 | A1* | 9/2020 | DeMoss | A47C 27/05 |
| 2020/0288873 | A1* | 9/2020 | Jewett | A47C 27/064 |

FOREIGN PATENT DOCUMENTS

| | | | |
|---|---|---|---|
| AU | 2964877 | A | 4/1979 |
| AU | 4825179 | A | 1/1980 |
| AU | 515761 | B2 | 4/1981 |
| AU | 3437584 | | 4/1985 |
| AU | 7297987 | A | 11/1987 |
| AU | 4609889 | | 4/1990 |
| AU | 9005391 | A | 2/1992 |
| AU | 4662597 | | 4/1998 |
| AU | 6975298 | A | 11/1998 |
| AU | 4994901 | A | 12/2001 |
| AU | 7367201 | A | 1/2002 |
| AU | 2001297805 | | 4/2003 |
| AU | 2003205072 | A1 | 9/2003 |
| AU | 2003268425 | A1 | 4/2004 |
| AU | 2004283189 | A1 | 5/2005 |
| AU | 2005280479 | A1 | 3/2006 |
| AU | 2001249949 | B2 | 11/2006 |
| AU | 2008219052 | | 8/2008 |
| AU | 2009206026 | A1 | 7/2009 |
| AU | 2009212687 | A1 | 8/2009 |
| AU | 2010202712 | A1 | 7/2010 |
| AU | 2009342701 | A1 | 10/2010 |
| AU | 2010236454 | A1 | 10/2011 |
| AU | 2011338830 | A1 | 7/2013 |
| AU | 2012204359 | A1 | 7/2013 |
| AU | 2014236431 | A1 | 10/2015 |
| AU | 2012207475 | B2 | 10/2016 |
| AU | 2015396842 | A1 | 12/2017 |
| AU | 2018361236 | A1 | 5/2020 |
| BR | PI0112471 | A | 8/2003 |
| BR | 0115070-7 | | 1/2004 |
| BR | PI0111389 | A | 2/2004 |
| BR | PI0306959 | A | 11/2004 |
| BR | PI0313096 | A | 7/2005 |
| BR | PI0415440 | A | 12/2006 |
| BR | PI0514799 | A | 6/2008 |
| BR | PI0906744 | A2 | 7/2015 |
| BR | PI1014650 | A2 | 4/2016 |
| BR | PI0908426 | A2 | 5/2016 |
| BR | PI1314067 | A2 | 9/2016 |
| BR | PI1317409 | A2 | 10/2016 |
| BR | PI1318278 | A2 | 11/2016 |
| BR | PI1318279 | A2 | 11/2016 |
| CA | 721181 | A | 11/1965 |
| CA | 730050 | A | 3/1966 |
| CA | 730051 | A | 3/1966 |
| CA | 935574 | A1 | 10/1973 |
| CA | 938740 | A1 | 12/1973 |
| CA | 1052916 | A1 | 4/1979 |
| CA | 1127324 | A1 | 7/1982 |
| CA | 1179074 | A1 | 12/1984 |
| CA | 1290472 | C | 10/1991 |
| CA | 2411702 | A1 | 12/2001 |
| CA | 2415904 | A1 | 1/2002 |
| CA | 2430330 | | 4/2003 |
| CA | 2471977 | A1 | 7/2003 |
| CA | 2495780 | A1 | 3/2004 |
| CA | 2539008 | A1 | 5/2005 |
| CA | 2578144 | A1 | 3/2006 |
| CA | 2678855 | A1 | 8/2008 |
| CA | 2712457 | | 1/2009 |
| CA | 2714397 | A1 | 8/2009 |
| CA | 2758906 | A1 | 10/2010 |
| CA | 2708212 | A1 | 2/2011 |
| CA | 140155 | S | 12/2011 |
| CA | 140156 | S | 12/2011 |
| CA | 2820219 | A1 | 6/2012 |
| CA | 2823387 | A1 | 7/2012 |
| CA | 2824985 | A1 | 7/2012 |
| CA | 2825044 | A1 | 7/2012 |
| CA | 2906122 | A1 | 9/2014 |
| CA | 2988071 | A1 | 12/2016 |
| CA | 2820219 | C | 10/2017 |
| CA | 172824 | S | 11/2017 |
| CA | 172825 | S | 11/2017 |
| CA | 172826 | S | 11/2017 |
| CA | 172827 | S | 11/2017 |
| CA | 172828 | S | 11/2017 |
| CA | 172829 | S | 11/2017 |
| CA | 172830 | S | 11/2017 |
| CA | 176681 | S | 11/2017 |
| CA | 176683 | S | 11/2017 |
| CA | 176684 | S | 11/2017 |
| CA | 176685 | S | 11/2017 |
| CA | 176686 | S | 11/2017 |
| CA | 176705 | S | 11/2017 |
| CA | 176706 | S | 11/2017 |
| CA | 3080354 | A1 | 5/2019 |
| CH | 406554 | A | 1/1966 |
| CN | 1431879 | A | 7/2003 |
| CN | 1682040 | | 10/2005 |
| CN | 1682040 | A | 10/2005 |
| CN | 1230267 | | 12/2005 |
| CN | 1964650 | A | 5/2007 |
| CN | 101052331 | A | 10/2007 |
| CN | 101977535 | A | 2/2011 |
| CN | 101990413 | A | 3/2011 |
| CN | 301837054 | S | 2/2012 |
| CN | 102395302 | A | 3/2012 |
| CN | 302060365 | S | 9/2012 |
| CN | 302078253 | S | 9/2012 |
| CN | 302078254 | S | 9/2012 |
| CN | 103313629 | A | 9/2013 |
| CN | 103313630 | A | 9/2013 |
| CN | 103327850 | A | 9/2013 |
| CN | 103327851 | A | 9/2013 |
| CN | 105377082 | A | 3/2016 |
| CN | 103313629 | B | 8/2016 |
| CN | 111278329 | A | 6/2020 |
| DE | 2113901 | A1 | 2/1972 |
| DE | 2927262 | A1 | 1/1980 |
| DE | 29721205 | U1 | 1/1999 |
| DE | 69734681 | | 12/2005 |
| DK | 2418985 | T3 | 6/2016 |
| DK | 2967222 | T3 | 3/2018 |
| EM | 001620725-0001 | | 10/2009 |
| EP | 156883 | A1 | 10/1985 |
| EP | 269681 | A1 | 6/1988 |
| EP | 1018911 | A1 | 7/2000 |
| EP | 1286611 | A1 | 3/2003 |
| EP | 1327087 | A1 | 7/2003 |
| EP | 1337357 | | 8/2003 |

(56) References Cited

FOREIGN PATENT DOCUMENTS

| | | | |
|---|---|---|---|
| EP | 1537045 | A2 | 6/2005 |
| EP | 1682320 | A2 | 7/2006 |
| EP | 1784099 | | 5/2007 |
| EP | 2112896 | | 11/2009 |
| EP | 2112896 | A2 | 11/2009 |
| EP | 2244607 | A1 | 11/2010 |
| EP | 2296509 | A1 | 3/2011 |
| EP | 2418985 | A1 | 2/2012 |
| EP | 2648573 | A1 | 10/2013 |
| EP | 2661196 | A1 | 11/2013 |
| EP | 2665391 | A1 | 11/2013 |
| EP | 2665392 | A1 | 11/2013 |
| EP | 2946696 | A1 | 11/2015 |
| EP | 2954801 | A1 | 12/2015 |
| EP | 2967222 | A1 | 1/2016 |
| EP | 3302179 | A1 | 4/2018 |
| EP | 3389450 | A1 | 10/2018 |
| EP | 3405073 | A1 | 11/2018 |
| EP | 3554315 | A1 | 10/2019 |
| EP | 3562351 | A1 | 11/2019 |
| EP | 3703537 | A1 | 9/2020 |
| ES | 482352 | A1 | 4/1980 |
| ES | 252961 | U | 2/1981 |
| ES | 2249804 | T3 | 4/2006 |
| ES | 2575555 | T3 | 6/2016 |
| ES | 2660293 | T3 | 3/2018 |
| FR | 2430743 | A1 | 2/1980 |
| FR | 2750584 | A1 | 1/1998 |
| GB | 494428 | | 10/1938 |
| GB | 976021 | A | 11/1964 |
| GB | 1284690 | A | 8/1972 |
| GB | 2025217 | A | 1/1980 |
| GB | 1577584 | A | 10/1980 |
| GB | 2215199 | A | 9/1989 |
| IN | 1686DELNP2007 | | 8/2007 |
| IN | 7883DELNP2011 | | 9/2013 |
| IN | 5595DELNP2013 | | 12/2014 |
| IN | 5701DELNP2013 | | 12/2014 |
| IN | 6306DELNP2013 | | 12/2014 |
| IN | 6307DELNP2013 | | 12/2014 |
| IN | 201717043686 | | 1/2018 |
| JP | 53085668 | A | 7/1978 |
| JP | 55014095 | A | 1/1980 |
| JP | 63035206 | A | 2/1988 |
| JP | 01004763 | B | 1/1989 |
| JP | 4084750 | | 4/2008 |
| JP | 2015051285 | A | 3/2015 |
| JP | 5710124 | | 4/2015 |
| JP | 2021500976 | A | 1/2021 |
| KR | 19830002865 | A | 5/1983 |
| KR | 19830002865 | B1 | 12/1983 |
| KR | 100355167 | B1 | 9/2002 |
| KR | 1020070026321 | A | 3/2007 |
| KR | 10-0730278 | | 6/2007 |
| KR | 100730278 | B1 | 6/2007 |
| KR | 100735773 | B1 | 6/2007 |
| KR | 1020070057164 | A | 6/2007 |
| KR | 1020090122230 | A | 11/2009 |
| KR | 1020120024585 | A | 3/2012 |
| KR | 1020120030303 | A | 3/2012 |
| KR | 1020130140089 | A | 12/2013 |
| KR | 1020140006899 | A | 1/2014 |
| KR | 1020140031187 | A | 3/2014 |
| KR | 1020140032995 | A | 3/2014 |
| KR | 101559748 | B1 | 10/2015 |
| KR | 1020170081298 | A | 7/2017 |
| KR | 101970351 | B1 | 4/2019 |
| KR | 102070175 | B1 | 1/2020 |
| KR | 102090031 | B1 | 3/2020 |
| KR | 20200066739 | A | 6/2020 |
| MX | 150175 | A | 3/1984 |
| MX | 02011719 | A | 5/2003 |
| MX | 03004813 | | 3/2004 |
| MX | 03000300 | A | 12/2004 |
| MX | 04006971 | A | 12/2004 |
| MX | 05002627 | A | 9/2005 |
| MX | 06004139 | A | 6/2006 |
| MX | 2007002292 | A | 10/2007 |
| MX | 2009008861 | A | 11/2009 |
| MX | 2010007835 | A | 9/2010 |
| MX | 2010008675 | A | 10/2010 |
| MX | 2011010876 | A | 11/2011 |
| MX | 2010007836 | A | 9/2012 |
| MX | 2013006310 | A | 7/2013 |
| MX | 2013007934 | A | 8/2013 |
| MX | 314236 | | 10/2013 |
| MX | 2013008403 | A | 10/2013 |
| MX | 2013008404 | A | 10/2013 |
| MX | 2015012909 | A | 12/2015 |
| NZ | 525792 | | 11/2004 |
| NZ | 579217 | | 5/2011 |
| NZ | 587211 | | 10/2012 |
| SG | 98527 | | 7/2005 |
| TW | 512085 | | 12/2002 |
| TW | 659554 | A | 11/2003 |
| TW | 200611658 | A | 4/2006 |
| TW | 201230986 | A | 8/2012 |
| WO | 8501424 | A1 | 4/1985 |
| WO | 8706987 | A1 | 11/1987 |
| WO | 0193726 | A1 | 12/2001 |
| WO | 0204838 | A1 | 1/2002 |
| WO | 02056736 | A2 | 7/2002 |
| WO | 0204838 | A9 | 2/2003 |
| WO | 03061932 | A2 | 7/2003 |
| WO | 2004024617 | A2 | 3/2004 |
| WO | 2005039849 | A2 | 5/2005 |
| WO | 2006026062 | A2 | 3/2006 |
| WO | 2008103332 | A2 | 8/2008 |
| WO | 2008143595 | | 11/2008 |
| WO | 2009091945 | A1 | 7/2009 |
| WO | 2009099993 | A1 | 8/2009 |
| WO | 2010117352 | A1 | 10/2010 |
| WO | 2010120886 | A1 | 10/2010 |
| WO | 2012027663 | A1 | 3/2012 |
| WO | 2012078398 | A1 | 6/2012 |
| WO | 2012088224 | A1 | 6/2012 |
| WO | 2012094468 | A1 | 7/2012 |
| WO | 2012097120 | A2 | 7/2012 |
| WO | 2012099812 | A1 | 7/2012 |
| WO | 2012099936 | A1 | 7/2012 |
| WO | 2012155131 | A1 | 11/2012 |
| WO | 2012097120 | A3 | 6/2014 |
| WO | 2014152935 | A1 | 9/2014 |
| WO | 2014152953 | A1 | 9/2014 |
| WO | 2016122453 | A1 | 8/2016 |
| WO | 2016195700 | A1 | 12/2016 |
| WO | 2017105454 | A1 | 6/2017 |
| WO | 2017116405 | | 7/2017 |
| WO | 2017116405 | A1 | 7/2017 |
| WO | 2017116406 | | 7/2017 |
| WO | 2017116406 | A1 | 7/2017 |
| WO | 2017127082 | A1 | 7/2017 |
| WO | 20170127082 | | 7/2017 |
| WO | 2017200839 | A2 | 11/2017 |
| WO | 2018112341 | A1 | 6/2018 |
| WO | 2018118035 | | 6/2018 |
| WO | 2018118035 | A1 | 6/2018 |
| WO | 2018118037 | | 6/2018 |
| WO | 2018118037 | A1 | 6/2018 |
| WO | 2018200679 | A1 | 11/2018 |
| WO | 2019089429 | A1 | 5/2019 |
| ZA | 2003/03457 | | 5/2004 |
| ZA | 2005/01090 | | 10/2006 |

OTHER PUBLICATIONS

Ukrainian Patent Office, Official Action issued in corresponding Application No. 2020 03249 dated Dec. 21, 2021.

China National Intellectual Property Administration, Notification of First Office Action dated corresponding Application No. 201880070602.0, issued Aug. 19, 2021.

European Patent Office, Extended Search Report issued in corresponding Application No. 18872828.1, dated Jul. 12, 2021.

(56) References Cited

OTHER PUBLICATIONS

The International Bureau of WIPO, International Preliminary Report on Patentability for PCT/US2018/057948 dated May 5, 2020, 8 pages.

* cited by examiner

POCKET COIL SPRING ASSEMBLY INCLUDING FLEXIBLE FOAM

CLAIM TO PRIORITY

This 35 U.S.C. § 371 National Stage Patent Application claims priority to PCT Patent Application No. PCT/US2018/057948, filed Oct. 29, 2018 and titled "Pocket Coil Spring Assembly Including Flexible Foam", which claims priority to and benefit of, under 35 U.S.C. § 119(e), U.S. Provisional Application Ser. No. 62/579,209, filed Oct. 31, 2017 and titled "Pocket Coil Spring Assembly Including Flexible Foam", all of which is incorporated herein by reference.

TECHNICAL FIELD

The present embodiments relate to pocket coil spring assemblies. In particular, the present embodiments relate to pocket coil spring assemblies that include an amount of flexible foam positioned either on top of the coil springs or in areas between rows of coil springs.

BACKGROUND

Spring assemblies that make use of pocket coil springs, which are also known as wrapped coils, encased coils, encased springs, or Marshall coils, are generally recognized as providing a unique feel to a mattress when used as a part of a spring assembly because each discrete coil is capable of moving independently to support the body of a user, or a portion thereof, resting on the mattress. In particular, in pocket coil spring assemblies, each coil is wrapped in a fabric pocket and moves substantially independently of the other coils in the pocket coil spring assembly to thereby provide individualized comfort and contouring to the body of a user. Moreover, as a result of moving substantially independently from one another, the pocket coils also do not directly transfer motion from one pocket coil to another, such that the movement of one user resting on a mattress assembly using pocket coils will not disturb another user resting on the mattress assembly. In this regard, mattress assemblies constructed with pocket coil springs are generally recognized as providing a soft and luxurious feel, and are often more desirable than a traditional inner spring mattress. Accordingly, a pocket coil spring assembly that improves the unique feel and support provided by traditional pocket coil springs would be both highly desirable and beneficial.

SUMMARY

The present embodiments include pocket coil spring assemblies. In particular, the present embodiments include pocket coil spring assemblies that include an amount of a flexible foam positioned either on top of the coil spring or disposed between rows of coil springs.

In one exemplary embodiment, a pocket coil spring assembly is provided that comprises a coil spring having an upper portion and a lower portion collectively defining a height of the coil spring. A fabric pocket encases the coil spring, and includes a top area covering the upper portion of the coil spring and a bottom area covering the lower portion of the coil spring. An amount of flexible foam in the shape of a hemisphere is then positioned on the top area of the fabric pocket.

In another embodiment, a mattress assembly is provided that comprises a spring core having a first support surface and a second support surface opposite the first support surface. The spring core includes a plurality of coil springs positioned in a matrix and extending in rows from a first end of the mattress assembly to a second end of the mattress assembly. Each of the coil springs included in the mattress assembly have an upper portion and a lower portion collectively defining a height of each coil spring. Fabric pockets encase each one of the plurality of coil springs, with each fabric pocket including a top area covering the upper portion of each coil spring and a bottom area covering the lower portion of each coil spring. A plurality of amounts of a flexible foam, each having a top surface, are then positioned between the rows of the coil springs. In some embodiments, the amounts of flexible foam are small, discrete amounts of flexible foam, while in other embodiments, the flexible foam are continuous pieces of flexible foam that extend along the entire length of the rows.

Further features and advantages of the present embodiments will become evident to those of ordinary skill in the art after a study of the description, figures, and non-limiting examples in this document.

DESCRIPTION OF EXEMPLARY EMBODIMENTS

The present embodiments include pocket coil spring assemblies. In particular, the present invention includes pocket coil spring assemblies that include an amount of flexible foam positioned either on top of the coil springs or disposed between rows of coil springs in the assembly, either as single amount or a plurality of discrete amounts, and extending from one end of the mattress assembly to the other.

Figure 1:
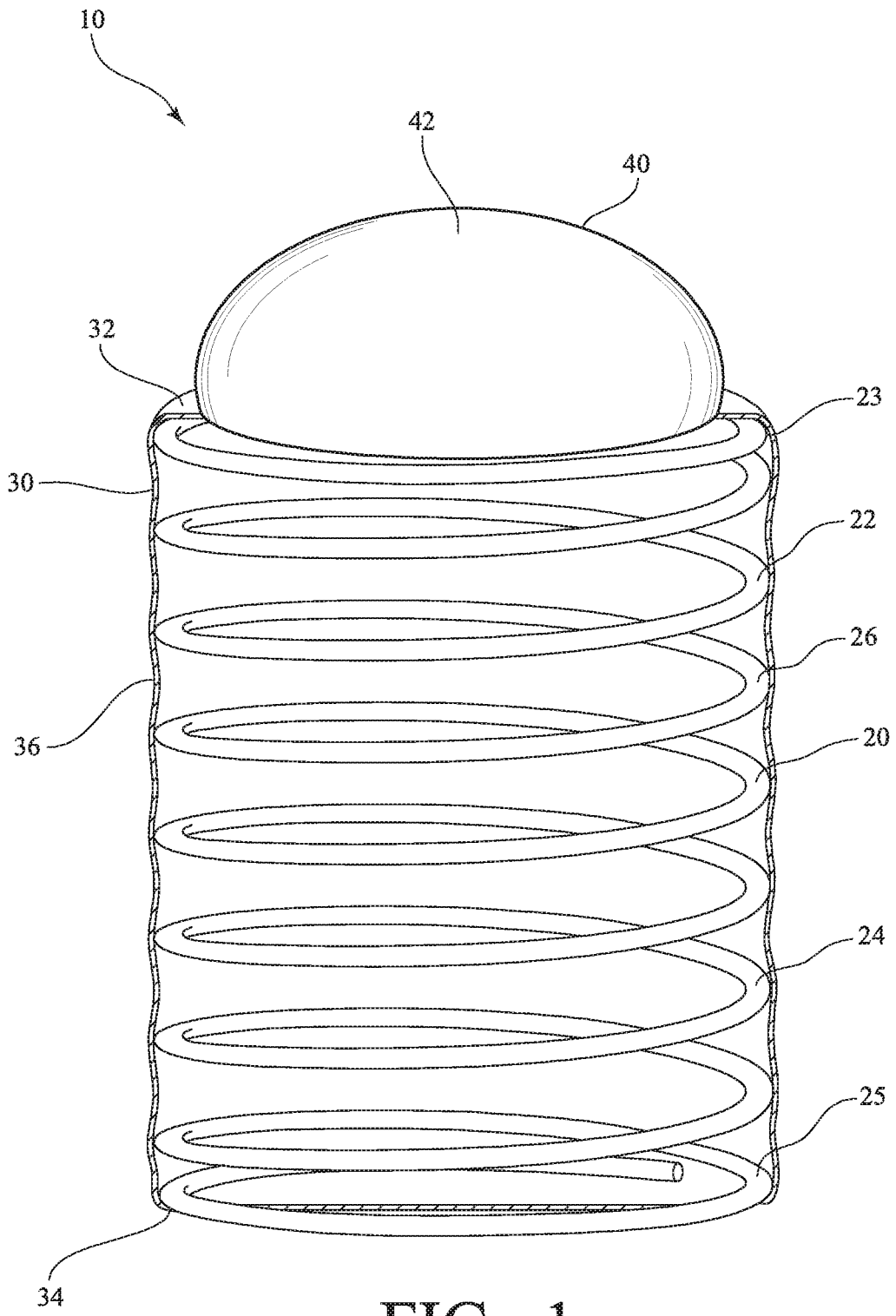
FIG. 1 is a side view of an exemplary pocket coil spring assembly made in accordance with the present embodiments with a portion of a fabric pocket of the pocket coil spring assembly removed to show a coil spring.

Referring first to FIG. 1, in one exemplary embodiment, a pocket coil spring assembly 10 is provided that includes a coil spring 20 having an upper portion 22 and a lower portion 24 which collectively define a height of the coil spring 20. The pocket coil spring assembly 10 further includes a fabric pocket 30 that encases the coil spring 20. Specifically, the fabric pocket 30 includes a top area 32 that covers the upper portion 22 of the coil spring 20, as well as a bottom area 34 that covers the lower portion 24 of the coil spring 20. Further included in the pocket coil spring assembly 10 is an amount of flexible foam 40 that is positioned on the top area 32 of the coil spring 20 and that has a top surface 42 that extends above the coil spring 20. The flexible foam 40 is depicted as a rounded shaped, for example a generally partial spherical or partial ovoid shaped. However, these are examples and other shapes may be used depending on the shape of the upper convolution of the coil spring. For example if a polygon shaped upper convolution is used, it may be desirable to install a cube or other three dimensional polygon shaped foam.

With respect to the coil spring 20, the exemplary pocket coil spring assembly 10 shown in FIG. 1 includes a coil spring 20 made of a continuous wire that extends from an upper end convolution 23 at the upper portion 22 of the coil spring 20 to a lower end convolution 25 opposite the upper end convolution 23 at the lower portion 24 of the coil spring 20. In the coil spring 20, there are seven intermediate convolutions 26 that helically spiral between the upper end convolution 23 and the lower end convolution 25, such that the coil spring 20 is made of a total of nine convolutions or turns. Of course, various other springs, such as coil springs having a different number of convolutions, could also be used in an exemplary pocket coil spring assembly without departing from the spirit and scope of the present claims.

With respect to the fabric pocket 30, in the exemplary pocket coil spring assembly 10 shown in FIG. 1, the top area 32 and the bottom area 34 of the fabric pocket 30 extend along the outside of the coil spring 20 and form a generally cylindrical (or tubular) side surface 36 of the fabric pocket 30. In this regard, the fabric pocket 30 is preferably made of an inelastic fabric which can be joined or welded together by heat and pressure (e.g., via ultrasonic welding or by a similar thermal welding procedure) to form such a cylindrical structure. For example, suitable fabrics that can be used for the fabric pocket 30 can include one of various thermoplastic fibers known in the art that define a textile, such as non-woven polymer-based fabric, non-woven polypropylene material, or non-woven polyester material. The fabric pockets 30 may be formed of a single piece of fabric folded over the spring 20 or may be formed of two or more pieces of fabric. One or more welds may be used to close the fabric pocket 30.

Referring still to FIG. 1, the flexible foam 40 included in the pocket coil spring assembly 10 is generally comprised of a type of foam having a density suitable for supporting and distributing pressure from a user's body, or portion thereof, resting on the pocket coil spring assembly 10. Such flexible foams include, but are not limited to: latex foam; reticulated or non-reticulated visco-elastic foam (sometimes referred to as memory foam or low-resilience foam); reticulated or non-reticulated non-visco-elastic foam; high-resilience polyurethane foam; expanded polymer foams (e.g., expanded ethylene vinyl acetate, polypropylene, polystyrene, or polyethylene); and the like. In the exemplary embodiment shown in FIG. 1, the flexible foam 40 is comprised of a two-part polyurethane foam that can be dispensed as a liquid directly onto the top area 32 of the fabric pocket 30 to create a small, hemisphere (i.e., half of a sphere) that reacts and bonds to the fabric pocket 30 itself and that includes a top surface 42 having a convex shape and a flattened bottom surface (not shown). Of course, it is appreciated that varying the composition of the liquid can result in a different shape of the flexible foam 40. The amount of liquid dispense, and thus the amount of foam resulting, may vary.

With respect to hardness, the flexible foam 40 included in the pocket coil spring assembly 10 can, in some embodiments, have a hardness of at least about 10 N to no greater than about 80 N, as measured by exerting pressure from a plate against a sample of the material to a compression of at least 40% of an original thickness of the material at approximately room temperature (i.e., 21° C. to 23° C.), where the 40% compression is held for a set period of time as established by the International Organization of Standardization (ISO) 2439 hardness measuring standard. In some embodiments, the flexible foam 40 included in the pocket coil spring assembly 10 has a hardness of about 10 N, about 20 N, about 30 N, about 40 N, about 50 N, about 60 N, about 70 N, about 80 N, about 90 N, about 100 N, about 110 N, about 120 N, about 130 N, about 140 N, about 150 N, about 160 N, about 170 N, about 180 N, about 190 N, or about 200 N, to provide a desired degree of comfort and body-conforming or supporting qualities.

With respect to density, the flexible foam 40 included in the pocket coil spring assembly 10 can, in some embodiments, also have a density that assists in providing a desired degree of comfort and body-conforming qualities, as well as an increased degree of material durability. In some embodiments, the density of the flexible foam 40 included of the pocket coil spring assembly 10 has a density of no less than about 30 kg/m$^3$ to no greater than about 150 kg/m$^3$. In some embodiments, the density of the flexible foam 40 included in the pocket coil spring assembly 10 is about 15 kg/m$^3$, 20 kg/m$^3$, 25 kg/m$^3$, 30 kg/m$^3$, about 40 kg/m$^3$, about 50 kg/m$^3$, about 60 kg/m$^3$, about 70 kg/m$^3$, about 80 kg/m$^3$, about 90 kg/m$^3$, about 100 kg/m$^3$, about 110 kg/m$^3$, about 120 kg/m$^3$, about 130 kg/m$^3$, about 140 kg/m$^3$, or about 150 kg/m$^3$. Of course, the selection of a flexible foam having a particular density will affect other characteristics of the foam, including its hardness, the manner in which the foam responds to pressure, and the overall feel of the foam, but it should be appreciated that a flexible foam having a desired density and hardness can readily be selected for a particular pocket coil spring assembly or application as desired. Regardless of the particular properties of the flexible foam 40, a user's body, or portion thereof, resting on the pocket coil spring assembly 10 will be supported by both the flexible foam 40 as well as the coil spring 20, however, because the top surface 42 of the flexible foam 40 is positioned above the coil spring 20, the user's body, or portion thereof, resting on the pocket coil spring assembly 10 will only contact the flexible foam 40 and not the coil spring 20. Accordingly, the exemplary pocket coil spring assembly 10 advantageously combines the contact feel of foam with the durability and support of a spring.

As previously stated, the flexible foam 40 in the exemplary embodiment shown in FIG. 1 is comprised of a two-part polyurethane foam, but it is appreciated that other materials can be used in addition to or instead of a foam, such as a gel or a fibrous fill material. For example, in some embodiments, the flexible foam can comprise, or can be replaced with, a vinyl- or silicone-based gel or other similar material. As another example, in some embodiments, the flexible foam can comprise an elastomeric gelatinous material that is capable of providing a cooling effect by acting as a thermal dump or heat sink into which heat from a user's body, or portion thereof, positioned on the flexible foam 40 can dissipate. More specifically, in these embodiments, the flexible foam comprises a polyurethane-based gel made by combining Hyperlast® LU 1046 Polyol, Hyperlast® LP 5613 isocyanate, and a thermoplastic polyurethane film, which are each manufactured and sold by Dow Chemical Company Corp. (Midland, MI), and which can be combined to produce a gel having a thermal conductivity of 0.1776 W/m*K, a thermal diffusivity of 0.1184 $mm^2/s$, and a volumetric specific heat of 1.503 $MJ(/m^3K)$ as established by the International Organization of Standardization (ISO) 22007-2 volumetric specific heat measuring standard. It should also be appreciated that varying "zones," or areas, may be created by the plurality of spring coil and foam. For example, the density of the flexible foam may vary in different "zones," or areas, of the mattress assembly.

Furthermore, it is appreciated that the wire gauge, spring constant, pre-compression, and overall geometry of the coil spring used in a particular pocket coil spring assembly can also be readily varied and used to impart a particular feel or characteristic in an exemplary pocket coil spring assembly without departing from the spirit and scope of the present invention.

Figure 2:
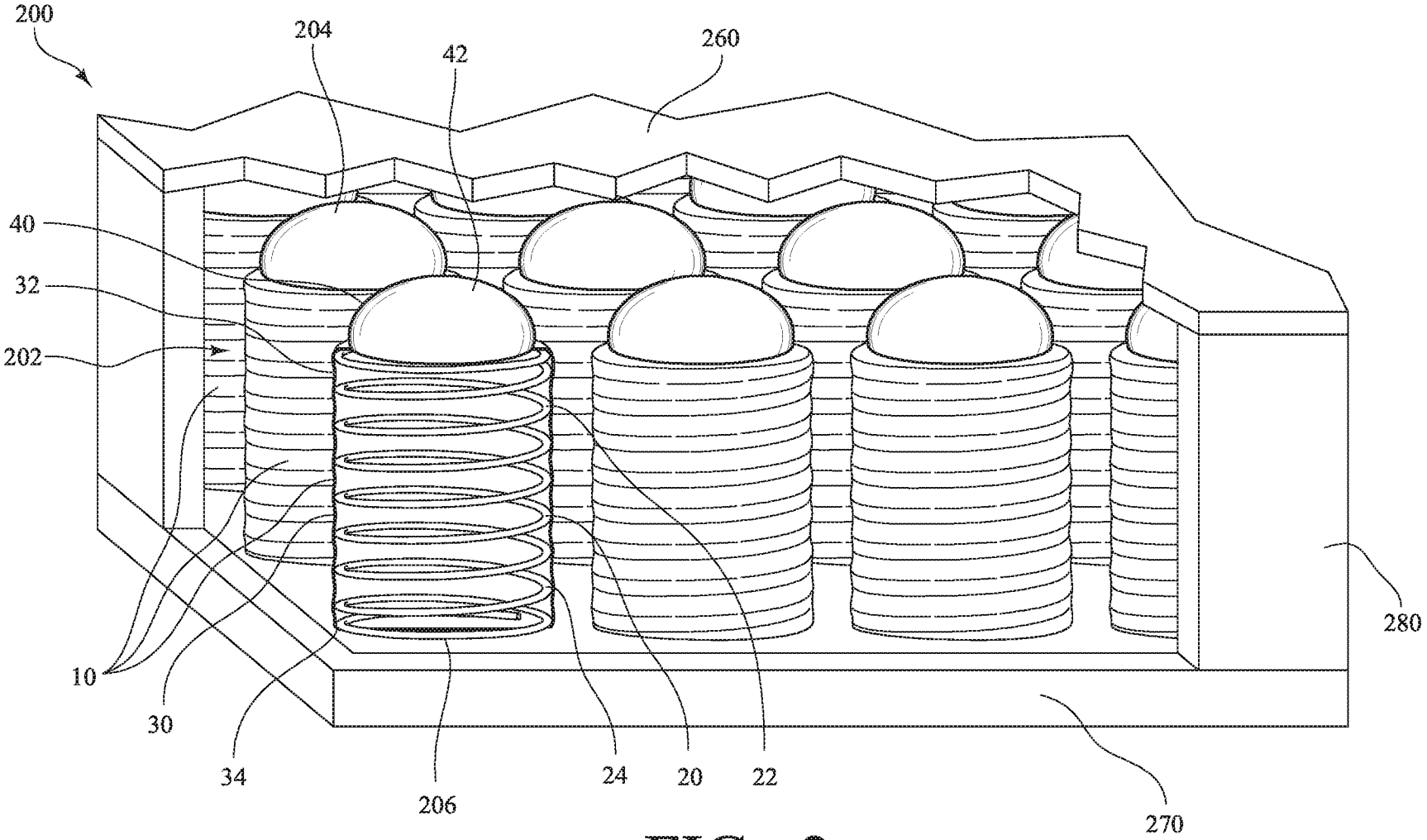
FIG. 2 is a perspective view of an exemplary mattress assembly made in accordance with the present embodiments with a portion of the mattress assembly removed to show a plurality of the pocket coil spring assemblies of FIG. 1 positioned in the interior of the mattress assembly.

Referring now to FIG. 2, in another embodiment, an exemplary mattress assembly 200 is provided that comprises a plurality of the pocket coil spring assemblies 10 described above with reference to FIG. 1. As shown in FIG. 2, the pocket coil spring assemblies 10 are arranged in a matrix and collectively form a spring core 202 having a first support surface 204 (or sleep surface), and a second support surface 206 opposite the first support surface 204. In the spring core 202 shown in FIG. 2, the pocketed coil spring assemblies 10 may be aligned in each of two dimensions of the mattress assembly 200, for example the head-foot dimension and the side-to-side dimension. In some other embodiments, the coil spring assemblies 10 may be aligned in one dimension and may be offset in a second perpendicular dimension. In still other embodiments, the coil spring assemblies 10 may be offset in two dimensions. The arrangements of any given matrix may vary.

Further, the longitudinal axes of each of the pocket coil spring assemblies 10 are arranged parallel with one another such that the top surface 42 of the flexible foam 40 of the pocket coil spring assemblies 10 forms, at least in part, the first support surface 204 of the spring core 202, and the bottom area 34 of the fabric pocket 30 along with the lower portion 24 of the coil spring 20 of each of the pocket coil spring assemblies 10 form the second support surface 206 of the spring core 202.

Additionally, in some embodiments, the exemplary mattress assembly 200 further comprises an upper body supporting layer 260 positioned adjacent to the first support surface 204 of the spring core 202, along with a lower foundation layer 270 positioned adjacent to the second support surface 206 of the spring core 202. A side panel 280 may extend between the upper body supporting layer and the lower foundation layer around the entire periphery of the spring core 202 such that the plurality of the pocket coil spring assemblies 10 are surrounded.

The upper body supporting layer 260 may be comprised of a visco-elastic foam; however, it is contemplated that the upper body supporting layer 260 can also be comprised of some combination of foam, upholstery, and/or other soft, flexible materials known in the art. Furthermore, the upper body supporting layer 260 can be comprised of multiple layers of material configured to improve the comfort or support of the upper body supporting layer. In contrast to the upper body supporting layer 260, the lower foundation layer 270 is generally comprised of a piece of wood, or other similarly rigid member, and is configured to support the plurality of pocket coil spring assemblies 10. In other embodiments, the lower foundation layer may be formed of foam or other material, less rigid, so that the mattress assembly 200 may be rolled, for shipping for example.

Figure 3:
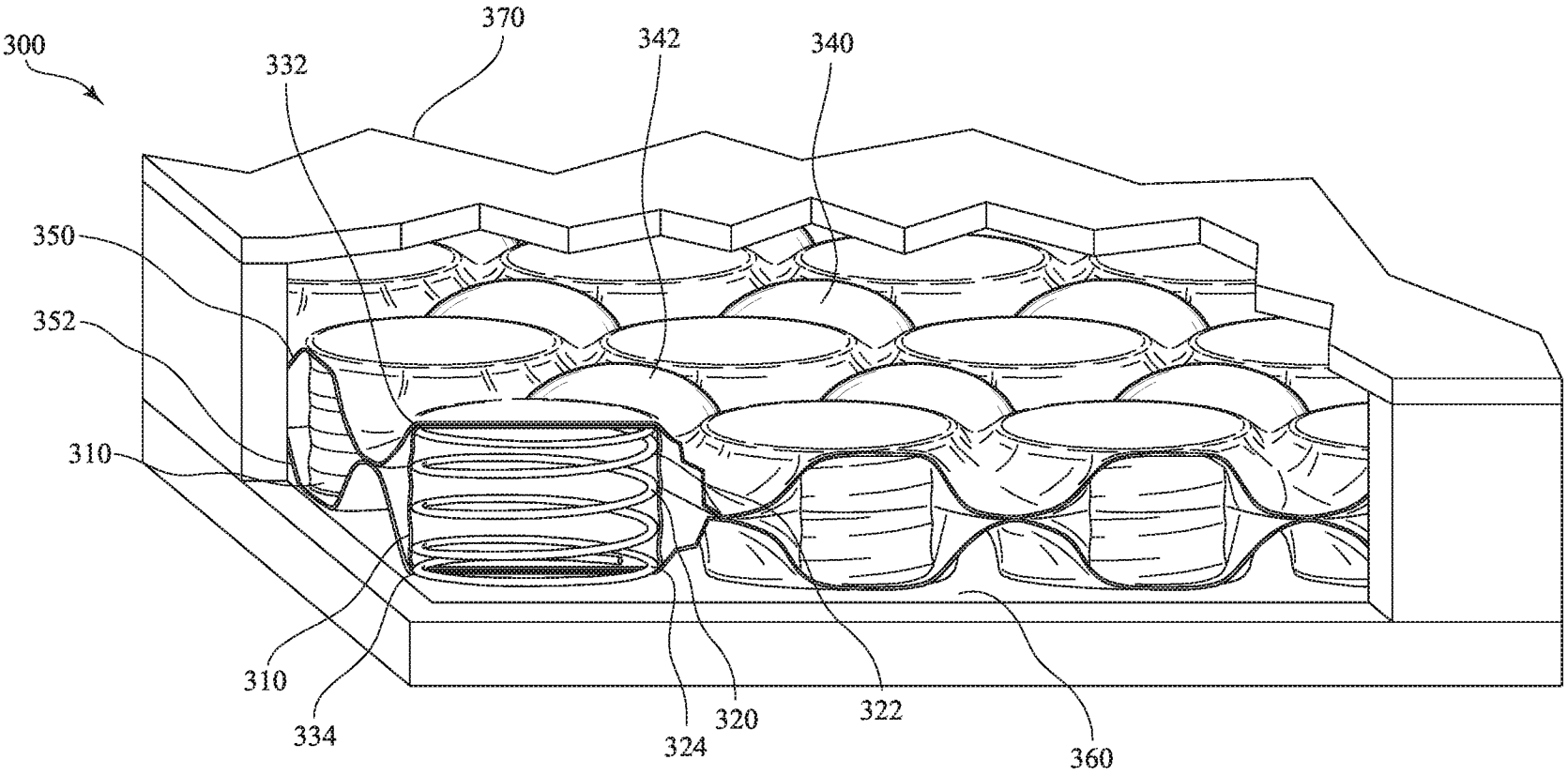
FIG. 3 is a perspective view of an exemplary mattress assembly made in accordance with the present embodiments with a portion of the mattress assembly removed to show a plurality of the pocket coil spring assemblies and an amount of flexible foam positioned between the rows of the pocket coil springs in the interior of the mattress assembly.

Referring now to FIG. 3, as another embodiment, an exemplary mattress assembly 300 is provided which comprises a plurality of pocket coil spring assemblies 310 that have a height that is less than the height of the coil springs described above with reference to FIGS. 1-2. The exemplary mattress assembly 300 shown in FIG. 3 further includes an upper continuous sheet 350 and a lower continuous sheet 352, which are described further below.

Each of the pocket coil spring assemblies 310 shown in FIG. 3 includes a coil spring 320 having an upper portion 322 and a lower portion 324 which collectively define a height of the coil spring 320. Each coil spring 320 in FIG. 3 is made of a continuous wire that extends from an upper end convolution at the upper portion 322 of the coil spring 320 to a lower end convolution opposite the upper end convolution at the lower portion 324 of the coil spring 320.

As noted, the exemplary mattress assembly 300 shown in FIG. 3 further includes an upper continuous sheet 350 which extends across the upper portion 322 of each of the plurality of coil springs 320, and a lower continuous sheet 352 which extends across the lower portion 324 of each of the plurality of coil springs 320. The upper continuous sheet 350 is connected to the lower continuous sheet 352 around and between each of the plurality of coil springs 320, such that the upper continuous sheet 350 and the lower continuous sheet 352 collectively form a fabric pocket that encases each of the coil springs 320. Specifically, a portion of the upper continuous sheet 350 forms, at least in part, the top area 332 of the fabric pocket that covers the upper portion 322 of the coil spring 320 of each of the plurality of pocket coil spring assemblies 310. Similarly, a portion of the lower continuous sheet 352 forms, at least in part, the bottom area 334 of the fabric pocket that covers the lower portion 324 of the coil spring 320 of each of the plurality of pocket coil spring assemblies 310.

Referring still to FIG. 3, the flexible foam 340 is disposed in areas between the pocket coil spring assemblies 310 instead of on top of the pocket coil spring assemblies, as shown in FIGS. 1 and 2. Specifically, the pocket coil spring assemblies 310 are arranged in a matrix extending from a lower foundation 360 of the mattress assembly 300 to a body supporting layer 370 of the mattress assembly. The flexible foams 340 of mattress assembly 300 are positioned in areas between the pocket coil spring assemblies 310 such that the top surface 342 of each flexible foam 340 is about the same height as the upper portion 322 of each of the pocket coil spring assemblies 310. For example, in the exemplary embodiment of FIG. 3, the top surface of each of the flexible foams 340 is level with the upper end convolution of each of the coil springs 320 such that the first support surface of the mattress assembly 300 is comprised of both the top surface 342 of the flexible foams 340 and the first convolutions of the upper portions 322 of the coil springs 320. This arrangement aids in filling gaps between the pocket coil spring assemblies 310.

Figure 4:
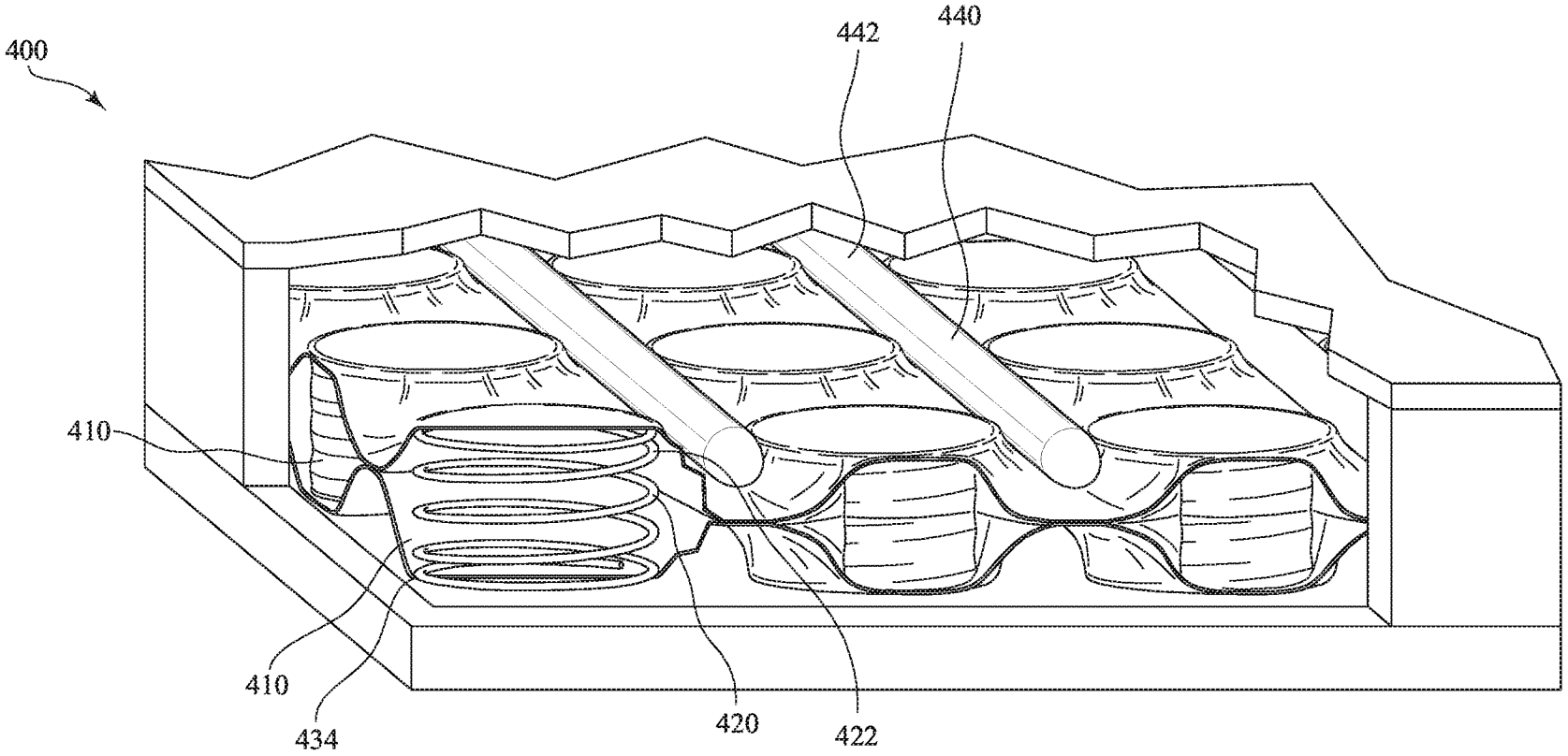
FIG. 4 is a perspective view of another exemplary mattress assembly made in accordance with the present embodiments with a portion of the mattress assembly removed to show a plurality of exemplary pocket coil spring assemblies and an amount of flexible foam positioned between the rows of the pocket coil springs in the interior of the mattress assembly.

Referring now to FIG. 4, as another embodiment, an exemplary mattress assembly 400 is provided that is substantially similar to the mattress assembly 300 described above with reference to FIG. 3, except that the flexible foam 440 is disposed in continuous amounts in the areas between the pocket coil spring assemblies 410, instead of in a matrix arrangement and instead on top of the pocket coil spring assemblies. Specifically, whereas the flexible foams 340 shown in FIG. 3 are discrete amounts that are positioned between the rows of coil springs 320, the flexible foams 440 shown in FIG. 4 extend in continuous amounts along the length of the rows of coil springs 420. In the depicted example, the rows extend in one direction, but alternatively may extend in the perpendicular direction of the mattress surface. Further, in some embodiments, the continuous amounts of the flexible foams 440 may extend in two directions wherein on of the directions is continuous first rows and the other direction forms second discontinuous rows extending between the first continuous rows. As with mattress assembly 300 of FIG. 3, each of the flexible foams 440 is positioned between coil spring assemblies 410 such that the top surface 442 of each flexible foam 440 is at about the same height as the upper portion 422 of each of the coil spring assemblies 410. Thus, an upper support surface of the mattress assembly 400 is comprised of both the top surface 442 of the flexible foams 440 and the first convolutions of the upper portions 422 of the coil springs 420.

One of ordinary skill in the art will recognize that additional embodiments are also possible without departing from the teachings of the present invention or the scope of the claims which follow. This detailed description, and particularly the specific details of the exemplary embodiments disclosed herein, is given primarily for clarity of understanding, and no unnecessary limitations are to be understood therefrom, for modifications will become apparent to those skilled in the art upon reading this disclosure and may be made without departing from the spirit or scope of the claimed invention.

What is claimed is:

1. A pocket coil spring assembly, comprising:

a coil spring having an upper portion and a lower portion, the upper portion and the lower portion collectively defining a height of the coil spring;

a fabric pocket encasing the coil spring, the fabric pocket including a top area covering the upper portion of the coil spring and a bottom area covering the lower portion of the coil spring; and an amount of a flexible foam dispensed as a liquid directly on the top area of the fabric pocket, the flexible foam positioned directly on the fabric pocket encasing the coil spring and entirely above the upper portion of the coil spring, wherein the liquid dispensed on the top area of the fabric pocket reacts to form a hemisphere with a top surface having a convex shape and a flattened bottom surface.

2. The pocket coil spring assembly of claim 1, wherein a top surface of the flexible foam has a convex shape.

3. The pocket coil spring assembly of claim 1, wherein the fabric pocket is comprised of a textile.

4. The pocket coil spring assembly of claim 1, wherein the flexible foam is comprised of a visco-elastic foam.

5. The pocket coil spring assembly of claim 1, wherein the flexible foam is comprised of a gel.

6. The pocket coil spring assembly of claim 1, wherein the liquid dispensed on the top area of the fabric pocket reacts and bonds to the fabric pocket such that the flexible foam is bonded to the fabric pocket.

* * * * *